US011408239B2

(12) United States Patent
Wan et al.

(10) Patent No.: US 11,408,239 B2
(45) Date of Patent: Aug. 9, 2022

(54) LONG-DISTANCE CORE DRILLING METHOD SUITABLE FOR A HORIZONTAL GEOLOGICAL CORE DRILLING RIG

(71) Applicant: HUNAN UNIVERSITY OF SCIENCE AND TECHNOLOGY, Hunan (CN)

(72) Inventors: Buyan Wan, Hunan (CN); Yongping Jin, Hunan (CN); Fenfei Peng, Hunan (CN); Jialiang Wang, Hunan (CN); Huan Liu, Hunan (CN)

(73) Assignee: HUNAN UNIVERSITY OF SCIENCE AND TECHNOLOGY, Xiangtan (CN)

( * ) Notice: Subject to any disclaimer, the term of this patent is extended or adjusted under 35 U.S.C. 154(b) by 0 days.

(21) Appl. No.: 17/485,861

(22) Filed: Sep. 27, 2021

(65) Prior Publication Data

US 2022/0010640 A1 Jan. 13, 2022

(30) Foreign Application Priority Data

Apr. 9, 2021 (CN) ..... 202110381813.X

(51) Int. Cl.

| | |
|---|---|
| ***E21B 25/02*** | (2006.01) |
| ***E21B 25/08*** | (2006.01) |
| ***E21B 25/16*** | (2006.01) |

(52) U.S. Cl.

CPC ..... *E21B 25/08* (2013.01); *E21B 25/02* (2013.01); *E21B 25/16* (2013.01)

(58) Field of Classification Search

CPC ..... E21B 25/02; E21B 25/04; E21B 25/00

See application file for complete search history.

(56) References Cited

U.S. PATENT DOCUMENTS

| | | | | |
|---|---|---|---|---|
| 3,794,127 | A * | 2/1974 | Davis | E21B 17/22 175/323 |
| 2018/0073316 | A1* | 3/2018 | Bai | E21B 25/16 |
| 2020/0157892 | A1* | 5/2020 | Gagnon | E21B 19/16 |
| 2021/0164300 | A1* | 6/2021 | Wan | E21B 31/18 |
| 2021/0222541 | A1* | 7/2021 | Tapson | E21B 25/16 |
| 2022/0010622 | A1* | 1/2022 | Wan | E21B 7/046 |

* cited by examiner

*Primary Examiner* — Kipp C Wallace

(57) ABSTRACT

A long-distance core drilling method suitable for a horizontal geological core drilling rig. (1) An active drill rod is connected to a drill rod, which is connected to a wireline-coring outer-tube drilling tool. (2) A steel-pipe string is connected to a fishing device, and the fishing device is connected to a spearhead on a core tube, which is placed to a designated position through a pipe-feeding mechanism. (3) A washing pump is started. (4) A core drilling is carried out. (5) A core is pulled out. (6) The steel-pipe string and the fishing device are reconnected. (7) The core tube is salvaged. (8) The core tube and drill pipe are replaced. (9) A hole is swept. (10) Steps (1)-(9) are repeated until the hole is drilled to a designated depth. (11) The core tube and the wireline-coring outer-tube drilling tool are recovered.

5 Claims, 3 Drawing Sheets

LONG-DISTANCE CORE DRILLING METHOD SUITABLE FOR A HORIZONTAL GEOLOGICAL CORE DRILLING RIG

CROSS-REFERENCE TO RELATED APPLICATIONS

This application claims the benefit of priority from Chinese Patent Application No. 202110381813.X, filed on Apr. 9, 2021. The content of the aforementioned application, including any intervening amendments thereto, is incorporated herein by reference in its entirety.

TECHNICAL FIELD

This application relates to geological exploration, and more particularly to a long-distance core drilling method suitable for a horizontal geological core drilling rig.

BACKGROUND

Horizontal geological core drilling rigs are commonly used in the engineering geological exploration. The core drilling using the horizontal geological core rig drilling is indispensable for obtaining the distribution of underground resources and the geological conditions of the underground engineering. Currently, a steel-strand core drilling rig is widely used in the short-distance core drilling. However, with respect to the long-distance core drilling, the wireline core drilling adopted by the existing steel-strand core drilling rigs still suffers the following problems. (1) The steel strand is required to have sufficient length to meet the requirements of the long-distance core drilling, such that a large storage rack of the steel strand is needed, which will occupy a large area of the tunnel, hindering the coring operations in the tunnel. (2) In one round trip operation of the existing steel-strand horizontal core drilling, the steel strand is required to be output and recovered at least 2 times, and the fishing device needs to be engaged with the spearhead twice and disengaged from the spearhead twice, rendering he auxiliary operation time-consuming.

SUMMARY

To solve the problems mentioned above, the present disclosure provides a long-distance core drilling method suitable for a horizontal geological core drilling rig. The method has simple operations, a high drilling efficiency and an excellent coring rate, and can greatly shorten the working time.

The technical solutions of the present disclosure are described as follows.

The present disclosure provides a long-distance core drilling method suitable for a horizontal geological core drilling rig, wherein a coring device adopted in the core drilling method comprises a horizontal wireline core drilling rig, a storage rack, a plurality of steel pipes, a drill pipe, a core tube and a fishing device; the horizontal wireline core drilling rig is provided with a pipe-straightening mechanism, a pipe-feeding mechanism, a washing pump, a power head, a thrust cylinder, an active drill pipe, a rotating chuck and a gripper; the pipe-straightening mechanism and the pipe-feeding mechanism are fixed on a support frame; one end of the thrust cylinder is hinged to the support frame; the other end of the thrust cylinder is connected to the power head through a connection block; the power head is arranged on a slide rail of the support frame; a piston rod of the thrust cylinder is configured to drive the power head to move on the slide rail by extension and contraction; the power head is connected to a rear end of the drill rod through the active drill rod and is configured to drive the drill rod to rotate; both ends of each of the plurality of steel pipes are provided with an external thread; the plurality of steel pipes are sequentially connected via a double-end stud to form a steel-pipe string; the steel-pipe string is wound on the storage rack; an end of the steel-pipe string passes through the pipe-straightening mechanism, the pipe-feeding mechanism and a sealing joint to be connected to the fishing device in the drill pipe; the sealing joint is arranged on the power head; the sealing joint is communicated with an inner cavity of the active drill rod; a fishing head of the fishing device is connected to a spearhead of the core tube; a water outlet of the washing pump is communicated with the inner cavity of the active drill rod through a rotating water-supply device; the rotating water-supply device is arranged on the power head; the rotating chuck and the gripper are arranged near a front end of the support frame; the rotating chuck is configured to connect the drill rod with a wireline-coring outer-tube drilling tool; and the gripper is configured to clamp and fix the drill rod; and the long-distance core drilling method comprises:

(1) threadedly connecting the active drill rod to the rear end of the drill rod; placing a threaded part of a front end of the drill rod in the rotating chuck; connecting the drill rod to an outer-tube assembly of the wireline-coring outer-tube drilling tool through the rotating chuck; and clamping and fixing the drill rod through the gripper;

(2) passing the steel-pipe string through the sealing joint; connecting the steel-pipe string to the fishing device; connecting the fishing device to the spearhead of the core tube in the wireline-coring outer-tube drilling tool; and lowering the core tube to a designated position through the pipe-feeding mechanism;

(3) turning on the washing pump to send wash water to the inner cavity of the active drill pipe through the rotating water-supply device;

(4) disassembling the steel-pipe string at the sealing joint into an inner steel-pipe string of the active drill pipe and an outer steel-pipe string of the active drill pipe; driving the power head through a motor to perform rotary drilling; and at the same time, driving the piston rod of the thrust cylinder to stretch out to drive the power head to move forward on the slide rail of the support frame;

(5) when the core tube is filled with a core sample, stopping stretching out the piston rod of the thrust cylinder forward; stopping rotating the power head; allowing the washing pump to stop pumping water; operating the power head to move back, so as to drive the drill rod and the wireline-coring outer-tube drilling tool to pull out the core sample;

(6) unscrewing a connecting thread between the active drill rod and the drill rod through the rotating chuck; transporting the outer steel-pipe string of the active drill pipe through the pipe-feeding mechanism to connect with the inner steel-pipe string of the active drill pipe at the sealing joint, so as to connecting the steel-pipe string with the fishing device;

(7) retracting the piston rod of the thrust cylinder to drive the power head to move back to an initial position before the drilling; and at the same time, lifting the core tube grasped by the fishing device to an entrance of a hole to complete a fishing operation;

(8) replacing the core tube with a new core tube; and connecting a new drill rod to the active drill rod through rotating the rotating chuck;

(9) sweeping the hole after the new drill rod is connected to the active drill rod;

(10) repeating steps (1)-(9) until the core drilling is performed to reach a designated depth; and

(11) recovering the core tube and the wireline-coring outer-tube drilling tool.

In some embodiments, in step (2), the core tube is lowered through the pipe-feeding mechanism at a lowing speed of 0.9 m/s; and in step (7), the core tube is lifted at a lifting speed of 1.1 m/s.

In some embodiments, in step (4), in the rotary drilling, a rotating speed of the power head is 300-1020 r/min, and a drilling speed of the power head is 4.5±2 mm/s.

In some embodiments, in step (3), a pumping capacity of the washing pump is 44-160 L/min.

In some embodiments, in step (5), a diameter of the core sample is no less than 49 mm.

In some embodiments, in step (9), a sweeping speed is 2.5 mm/s.

The beneficial effects of the present disclosure are described as follows.

(1) In a long-distance coring, the long-distance core drilling method provided herein can effectively adapt to narrow spaces such as tunnels and can realize a coring process in which only one round-trip of a fishing mechanism is required for one core-tube operation.

(2) The long-distance core drilling method provided herein requires less auxiliary work time and has a high coring rate, and is more suitable for long-distance coring.

Figure 1:
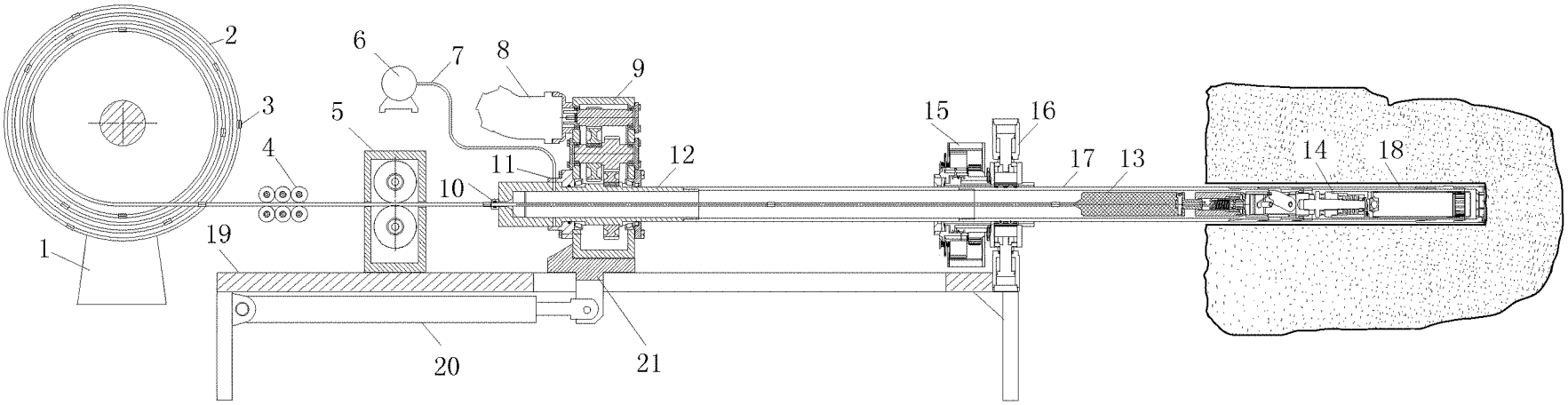
FIG. 1 schematically depicts a structure of a coring device used in a long-distance core drilling method in accordance with an embodiment of the present disclosure.

In the drawings, 1, storage rack; 2, steel pipe; 3, double-end stud; 4, pipe-straightening mechanism; 5, pipe-feeding mechanism; 6, washing pump; 7, water pipe; 8, motor; 9, power head; 10, sealing joint; 11, rotating water-supply device; 12, active drill pipe; 13, fishing device; 14, core tube; 15, rotating chuck; 16, gripper; 17, drill pipe; 18, wireline-coring outer-tube drilling tool; 19, support frame; 20, thrust cylinder; and 21, connecting block.

DETAILED DESCRIPTION OF EMBODIMENTS

The present disclosure will be further described in detail below with reference to the accompany drawings and embodiments.

Figure 2:
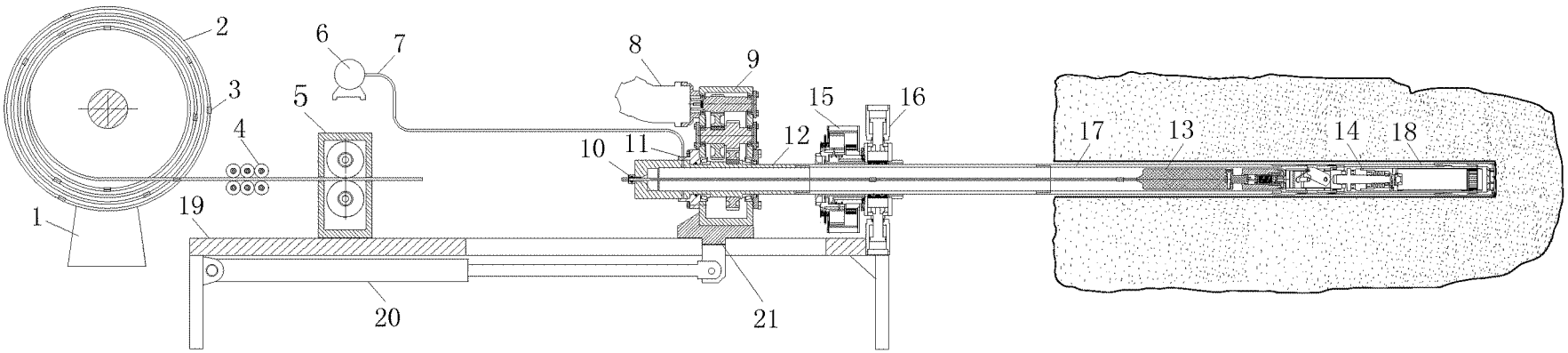
FIG. 2 schematically depicts drilling of the coring device in accordance with an embodiment of the present disclosure.
Figure 3:
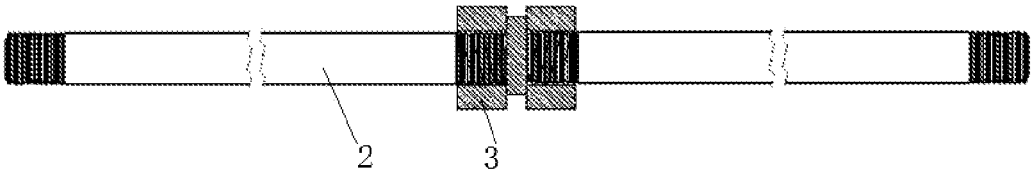
FIG. 3 schematically depicts a connection of steel pipes in the coring device in accordance with an embodiment of the present disclosure.

As shown in FIGS. 1-3, a coring device provided herein includes a storage rack 1, a steel pipe 2, a double-end stud 3, a pipe-straightening mechanism 4, a pipe-feeding mechanism 5, a washing pump 6, a water pipe 7, a motor 8, a power head 9, a sealing joint 10, an active drill pipe 12, a fishing device 13, a core tube 14, a rotating chuck 15, a gripper 16, a drill pipe 17, a wireline-coring outer-tube drilling tool 18, a support frame 19 and a thrust cylinder 20. The pipe-straightening mechanism 4, the pipe-feeding mechanism 5, the rotating chuck 15 and the holder 16 are sequentially fixed on the support frame 19 from left to right, and a right end of the support frame 19 is arranged close to a drilled hole. One end of the thrust cylinder 20 is hinged to the support frame 19, and the other end of the thrust cylinder 20 is connected to the power head 9. The power head 9 is arranged on a slide rail on the support frame 19, and a piston rod of the thrust cylinder 20 is configured to drive the power head 9 to move back and forth on the slide rail by extension and contraction.

The pipe-straightening mechanism 4 includes a plurality of rolling-wheel groups. The plurality of rolling-wheel groups are fixedly arranged on the support frame. Each rolling-wheel group of the plurality of rolling-wheel groups includes two rolling wheels. Axes of the two rolling wheels are in a vertical plane. Planes on which axes of the plurality of rolling-wheel groups are located are parallel. The pipe-feeding mechanism 5 includes a box body, an upper friction wheel and a lower friction wheel. The upper friction wheel and the lower friction wheel are fixedly arranged in the box body. An axis of the upper friction wheel and an axis of the lower friction wheel are parallel, and the axis of the upper friction wheel and the axis the lower friction wheel are located in a vertical plane, which is parallel to the vertical plane on which axes of rolling wheels in each rolling-wheel group are located. The box body is provided with a through hole for a steel-pipe string to pass through. An axle of the lower friction wheel is connected to the motor 8 through a decelerator. The motor 8 is configured to drive the lower friction wheel to rotate, so as to feed the steel pipe string.

The power head 9 is connected to a rear end of the drill rod 17 through the active drill rod 12 and drives the drill rod 17 to rotate. Both ends of the steel pipe 2 are provided with an external thread. A plurality of steel pipes 2 are sequentially connected by a double-end stud to form the steel-pipe string. The steel-pipe string is wound on the storage rack 1. An end of the steel-pipe string passes through the pipe-straightening mechanism 4, the pipe-feeding mechanism 5 and the sealing joint 10, and then is connected to the fishing device 13 in the drill pipe 17. The sealing joint 10 is arranged on the power head 9, and the sealing joint 10 is communicated with an inner cavity of the active drill rod 12. A fishing head of the fishing device 13 is connected to a spearhead of the core tube 14. A water outlet of the washing pump 6 is communicated with the inner cavity of the active drill rod 12 through a rotating water-supply device 11. The rotating water-supply device 11 is arranged on the power head 9. The rotating chuck 15 and the gripper 16 are arranged near a front end of the support frame 19. The rotating chuck 15 is configured to connect the drill rod 17 with a wireline-coring outer-tube drilling tool 18. The gripper 16 is configured to clamp and fix the drill rod 17.

A long-distance core drilling method suitable for using a horizontal drilling device includes following steps.

(1) Before drilling starts, the active drill rod 12 is threadedly connected to the rear end of the drill rod 17. A threaded part of a front end of the drill rod 17 is placed in the rotating chuck 15. The drill rod 17 is connected to wireline-coring outer-tube drilling tool 18 through the rotating chuck 15. The drill rod 17 is clamped and fixed by the gripper 16.

(2) The steel-pipe string is passed through the sealing joint 10, and connected to the fishing device 13. The fishing device 13 is connected to the spearhead of the core tube 14 in the wireline-coring outer-tube drilling tool 18, and is driven by the motor 8 of the pipe-feeding mechanism 5 to lower the core tube 14 to a designated position. A lowering speed is 0.9 m/s.

(3) The washing pump 6 is turned on to send wash water to the inner cavity of the active drill pipe 12 through the rotating water-supply device 11. A pumping capacity of the washing pump 6 is 44-160 L/min.

(4) The steel-pipe string, at the sealing joint 10, is disassembled into an inner steel-pipe string of the active drill pipe 12 and an outer steel-pipe string of the active drill pipe 12. The power head 9 is driven by the motor 8 to perform rotary drilling at a speed of 300-1020 r/min. At the same time, by driving the piston rod of the thrust cylinder 20 to stretched out, the power head 9 is driven to move forward on the slide rail of the support frame 19. A thrust of the thrust cylinder 20 is 38 KN.

(5) After a drilling round trip is completed, the piston rod of the thrust cylinder 20 stops moving forward. The power head 9 stops rotating. The washing pump 6 stops pumping water. The power head 9 is operated to move back for a short distance, so as to drive the drill rod 17 and the wireline-coring outer-tube drilling tool 18 to pull out a core sample. A maximum pull-out force is 80.3 kN.

(6) When the core tube 14 is filled with the core sample, a connection thread between the active drill rod 12 and the drill rod 17 is unscrewed through the rotating chuck 15. The outer steel-pipe string of the active drill pipe 12 of the steel-pipe string on the support frame 19 is transported through the pipe-feeding mechanism 5 to connect with the inner steel-pipe string of the active drill pipe 12 at the sealing joint. The steel-pipe string is connected to the fishing device 13.

(7) The piston rod of the thrust cylinder is retracted to drive the power head 9 to move back to an initial position before the drilling. Meanwhile, the core tube 14 grasped by the fishing device 13 is lifted to an entrance of a hole to complete a fishing operation.

(8) The core tube 14 is replaced with a new core tube 14. A new drill rod 17 is connected to the active drill rod 12 through rotating the rotating chuck 15.

(9) The hole is swept after the new drill rod is connected to the active drill rod, and a sweeping speed is 2.5 mm/s.

(10) Steps (1)-(9) are repeated until the hole is drilled to a designated depth. One round trip can achieve the delivery and fishing of the core tube.

(11) The core tube 14 and the wireline-coring outer-tube drilling tool 18 are recovered.

What is claimed is:

1. A long-distance core drilling method suitable for a horizontal geological core drilling rig, a coring device adopted in the core drilling method comprising a horizontal core drilling rig, a steel pipe storage rack, a plurality of steel pipes, a drill pipe, a core tube and a fishing device; the horizontal core drilling rig being provided with a pipe-straightening mechanism, a pipe-feeding mechanism, a washing pump, a power head, a thrust cylinder, an active drill pipe, a rotating chuck and a gripper; the pipe-straightening mechanism and the pipe-feeding mechanism being fixed on a support frame; one end of the thrust cylinder being hinged to the support frame; the other end of the thrust cylinder being connected to the power head through a connection block; the power head being arranged on a slide rail of the support frame; a piston rod of the thrust cylinder being configured to drive the power head to move on the slide rail by extension and contraction; the power head being connected to a rear end of the drill pipe through the active drill pipe and being configured to drive the drill pipe to rotate; both ends of each of the plurality of steel pipes being provided with an external thread; the plurality of steel pipes being sequentially connected via a double-end stud to form a steel-pipe string; the steel-pipe string being wound on the storage rack; an end of the steel-pipe string passing through the pipe-straightening mechanism, the pipe-feeding mechanism and a sealing joint to be connected to the fishing device in the drill pipe; the sealing joint being arranged on the power head; the sealing joint being communicated with an inner cavity of the active drill pipe; a fishing head of the fishing device being connected to a spearhead of the core tube; a water outlet of the washing pump being communicated with the inner cavity of the active drill pipe through a rotating water-supply device; the rotating water-supply device being arranged on the power head; the rotating chuck and the gripper being arranged near a front end of the support frame; the rotating chuck being configured to connect the drill pipe with a coring outer-tube drilling tool; and the gripper being configured to clamp and fix the drill pipe; and the core drilling method comprising:

(1) threadedly connecting the active drill pipe to the rear end of the drill pipe; placing a threaded part of a front end of the drill pipe in the rotating chuck; connecting the drill pipe to the coring outer-tube drilling tool through the rotating chuck; and clamping and fixing the drill pipe through the gripper;

(2) passing the steel-pipe string through the sealing joint; connecting the steel-pipe string to the fishing device; connecting the fishing device to the spearhead of the core tube in the coring outer-tube drilling tool; and lowering the core tube to a designated position through the pipe-feeding mechanism;

(3) turning on the washing pump to send wash water to the inner cavity of the active drill pipe through the rotating water-supply device;

(4) disassembling the steel-pipe string at the sealing joint into an inner steel-pipe string of the active drill pipe and an outer steel-pipe string of the active drill pipe; driving the power head through a motor to perform rotary drilling; and at the same time, driving the piston rod of the thrust cylinder to stretch out to drive the power head to move forward on the slide rail of the support frame;

(5) when the core tube is filled with a core sample, stopping stretching out the piston rod of the thrust cylinder forward; stopping rotating the power head; allowing the washing pump to stop pumping water; operating the power head to move back, so as to drive the drill pipe and the coring outer-tube drilling tool to pull out the core sample;

(6) unscrewing a connecting thread between the active drill pipe and the drill pipe through the rotating chuck; transporting the outer steel-pipe string of the active drill pipe through the pipe-feeding mechanism to connect with the inner steel-pipe string of the active drill pipe at the sealing joint, so as to connect the steel-pipe string with the fishing device;

(7) retracting the piston rod of the thrust cylinder to drive the power head to move back to an initial position; and lifting the core tube grasped by the fishing device to an entrance of a hole to complete a fishing operation;

(8) replacing the core tube with a new core tube; and connecting a new drill pipe to the active drill pipe through rotating the rotating chuck;

(9) repeating steps (1)-(8) until the core drilling is performed to reach a designated depth; and

(10) recovering the core tube and the coring outer-tube drilling tool.

2. The long-distance core drilling method of claim 1, wherein in step (2), the core tube is lowered through the pipe-feeding mechanism at a speed of 0.9 m/s; and in step (7), the core tube is lifted at a speed of 1.1 m/s.

3. The long-distance core drilling method of claim 1, wherein in step (4), in the rotary drilling, a rotating speed of the power head is 300-1020 r/min, and a drilling speed of the power head is 4.5±2 mm/s.

4. The long-distance core drilling method of claim 1, wherein in step (3), a pumping capacity of the washing pump is 44-160 L/min.

5. The long-distance core drilling method of claim 1, wherein in step (5), a diameter of the core sample is no less than 49 mm.

* * * * *